US006853830B2

(12) United States Patent
Sanmonji

(10) Patent No.: US 6,853,830 B2
(45) Date of Patent: Feb. 8, 2005

(54) TRANSFER DEVICE OF IMAGE FORMING APPARATUS EMPLOYING ELECTRO-PHOTOGRAPHIC PROCESS AND IMAGE FORMING APPARATUS DISPOSING THE SAME

(75) Inventor: Yoshinori Sanmonji, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/388,182

(22) Filed: Mar. 14, 2003

(65) Prior Publication Data

US 2004/0179873 A1 Sep. 16, 2004

(51) Int. Cl.[7] ..... G03G 15/16
(52) U.S. Cl. ..... 399/310; 399/316
(58) Field of Search ..... 399/310, 311, 399/313, 314, 316, 312

(56) References Cited

FOREIGN PATENT DOCUMENTS

JP 09197839 A * 7/1997 ..... G03G/15/16
JP 9-197840 A 7/1997

* cited by examiner

*Primary Examiner*—Quana Grainger
(74) *Attorney, Agent, or Firm*—Foley & Lardner LLP

(57) ABSTRACT

A voltage adjusting thin plate 16 is arranged below a roller before transfer 7 so as to be abutted on a surface of the roller before transfer 7 at a side opposite to a side where a transfer wire 18 of a transfer device 9 is located. A paper powder removing thin plate 17 is arranged at a lateral side of the roller before transfer 7 so as to be abutted on a surface of the roller before transfer 7 at the same side as a side where the transfer wire 18 of the transfer device 9 is located. A bias voltage whose polarity is the same as a polarity of toner is applied to the voltage adjusting thin plate 16 only for a desired period, at least, just after the image forming apparatus 1 is activated and while application of voltage to the transfer device 9 is being stopped. As materials of the voltage adjusting thin plate 16 and the paper powder removing thin plate 17, preferably two-axial extensible polyester film is used.

12 Claims, 5 Drawing Sheets

| APPLIED VOLTAGE (-KV) | 0 | 1.0 | 1.7 | 1.8 | 1.9 | 2.0 | 2.5 | 3.0 | 3.5 | 3.6 | 3.8 | 3.9 | 4.0 | 5.0 |
|---|---|---|---|---|---|---|---|---|---|---|---|---|---|---|
| DIRT ON THE BACK OF PAPER | × | × | × | △ | △ | ○ | ○ | ○ | ○ | ○ | ○ | ○ | ○ | ○ |
| SLIPPING-OUT OF TRANSFER | ○ | ○ | ○ | ○ | ○ | ○ | ○ | ○ | ○ | △ | △ | △ | × | × |
| REFLECTION RATE OF DIRT ON ROLLER (%) | 54.28 | 41.88 | 39.29 | 39.66 | 39 | 40.08 | 33.58 | 27.2 | 24.32 | 24.24 | 26 | 24.3 | 22.5 | 17.4 |
| ELECTRICAL POTENTIAL ON THE SURFACE OF ROLLER | 1653 | 1233 | 1068 | 1023 | 995 | 943 | 848 | 750 | 660 | 634 | 610 | 567 | 547 | 262 |

FIG. 4

TRANSFER DEVICE OF IMAGE FORMING APPARATUS EMPLOYING ELECTRO-PHOTOGRAPHIC PROCESS AND IMAGE FORMING APPARATUS DISPOSING THE SAME

BACKGROUND OF THE INVENTION

1. Field of the Invention

The present invention relates to a transfer device of image forming apparatus employing an electro-photographic process such as a laser printer or an electro-photographic copying machine, and particularly a transfer device attaching a roller arranged before transfer area which is hereinafter called "a roller before transfer", and an image forming apparatus disposing the same.

2. Related Art Statement

An image-forming using an image forming apparatus employing an electro-photographic process such as a laser printer or an electro-photographic copying machine is generally performed as follows.

First, a surface of a photosensitive drum is charged a desired charging voltage Vo such as −630 [V] by a charging device. Next, the surface of the photosensitive drum is exposed by an exposure device such as a semiconductor laser. As a result, an electrostatic latent image is formed on the surface thereof. The surface voltage of the exposed photosensitive drum is attenuated, resulting in that the surface voltage of the latent image forming portion becomes a residual voltage Vr such as −40 [V]. After the electrostatic latent image is formed, a bias voltage such as −460[V], the polarity of which is substantially as same as that of the surface voltage of the photosensitive drum, negative polarity, is applied onto a surface of a developing roller of a developing device and the developing process, the reverse developing process, is performed using charged toner having a negative polarity.

The toner attached to the surface of the photosensitive drum at the developing process is transferred onto a surface of a recording paper by a transfer device which has the recording paper charged a positive polarity, attaching a roller before transfer made of rubber which guides the recording paper to a transfer area. Such a roller before transfer mainly serves as assisting transportation of the recording paper to guide the recording paper to the transfer area, preventing the transferred image from being slipped out by enhancing contact-ability between the surface of the recording paper and the surface of the photosensitive drum and so on.

However, the roller before transfer is arranged in the vicinity of the transfer area, resulting in causing defect that the roller before transfer is easy to be affected by discharging from the transfer device. The surface of the roller before transfer discharged by charge of a polarity, a positive polarity, opposite to the polarity of the charged toner attracts scattered toner or unexpected toner which covers the surface of the photosensitive drum, resulting in that the surface of the roller becomes dirty, thereby the back face of the recording paper becomes dirty.

As a transfer device for preventing the back face of the recording paper from being dirty, there has been known a transfer device provided with a shielding plate made of insulator material which shields discharging action from a transfer wire of the transfer device to a surface of the roller before transfer, disclosed in Japanese Patent laid-open No. 9-197840, and a transfer device provided with a cleaning mechanism which cleans a dirty surface of the roller before transfer.

As to the transfer device provided with the shielding plate as mentioned above, particularly in a case where a photosensitive drum having a small diameter is used, it is natural that the transfer device becomes smaller, so that the width of a discharging opening of the transfer device is partially shielded by the shielding plate, or the width thereof is extraordinarily restricted. The narrower, the width of the discharging opening of the transfer device becomes, the smaller, strength of discharging for the recording paper becomes. Therefore, in order to secure a desired amount of discharging electric charge, higher voltage must be applied to the transfer wire. Thus, there is a problem of safety, e.g., that an amount of generating ozone will be increased and it is not realistic to arrange only the shielding plate in view of cost. Further, a disadvantage as to transferring efficiency will apparently occur because a discharging area in the surface of the photosensitive drum becomes smaller.

On the other hand, as to the transfer device is provided with the cleaning mechanism as mentioned above, particularly in a case where a photosensitive drum having a small diameter is used and the transfer device indispensably becomes smaller, it is difficult to arrange the cleaning mechanism because of small space and further it becomes disadvantageous in view of cost in order to dispose an extra mechanism such as the cleaning mechanism.

SUMMARY OF THE INVENTION

An aspect of the present invention has been accomplished in view of problems as noted above with respect to the above-mentioned conventional art in a transfer device provided with a roller before transfer, and has an object to provide a transfer device in which a surface of the roller before transfer is hard to attract scattered toner and/or unexpected toner covering a surface of a photosensitive drum, resulting in that the surface of the roller does not become dirty and also the back face of a recording paper does not become dirty, and an image forming apparatus in which the transfer device is arranged.

Further, an aspect of the present invention has an object to provide a transfer device taken into consideration for cost, space and safety, in which, even in a case where a photosensitive drum having a small diameter is used, transfer efficiency is not deteriorated owing not to narrow the width of a discharging opening of the transfer device, and an ozone generating amount is not increased owing not to apply a higher voltage to a transfer wire, and has an object to provide an image forming apparatus in which the transfer device is arranged.

For achieving the aforementioned objects, the transfer device of an aspect of the present invention comprises a roller before transfer which guides a recording paper to a transfer area and a voltage adjusting thin plate which cancels charge on the surface of the roller before transfer, being contact with the surface of the roller before transfer and being applied a bias voltage having the same polarity as charged toner.

Further, the image forming apparatus of an aspect of the present invention is characterized by providing with the transfer device comprising a roller before transfer which guides a recording paper to a transfer area and a voltage adjusting thin plate which removes charge on the roller before transfer, being contact with the surface of the roller before transfer and being applied a bias voltage having the same polarity as charged toner.

BRIEF DESCRIPTION OF THE DRAWINGS

FIG. 4 is a table indicating a relationship between a surface voltage of the roller before transfer and back surface dirt and slipping-out of the transferred image on the recording paper in a case where the voltage applied to a voltage adjusting thin plate is changed.

DETAILED DESCRIPTION OF THE INVENTION

It will be explained in detail about the transfer device according to embodiments of the present invention and the image forming apparatus in which the transfer device is arranged.

Figure 1:
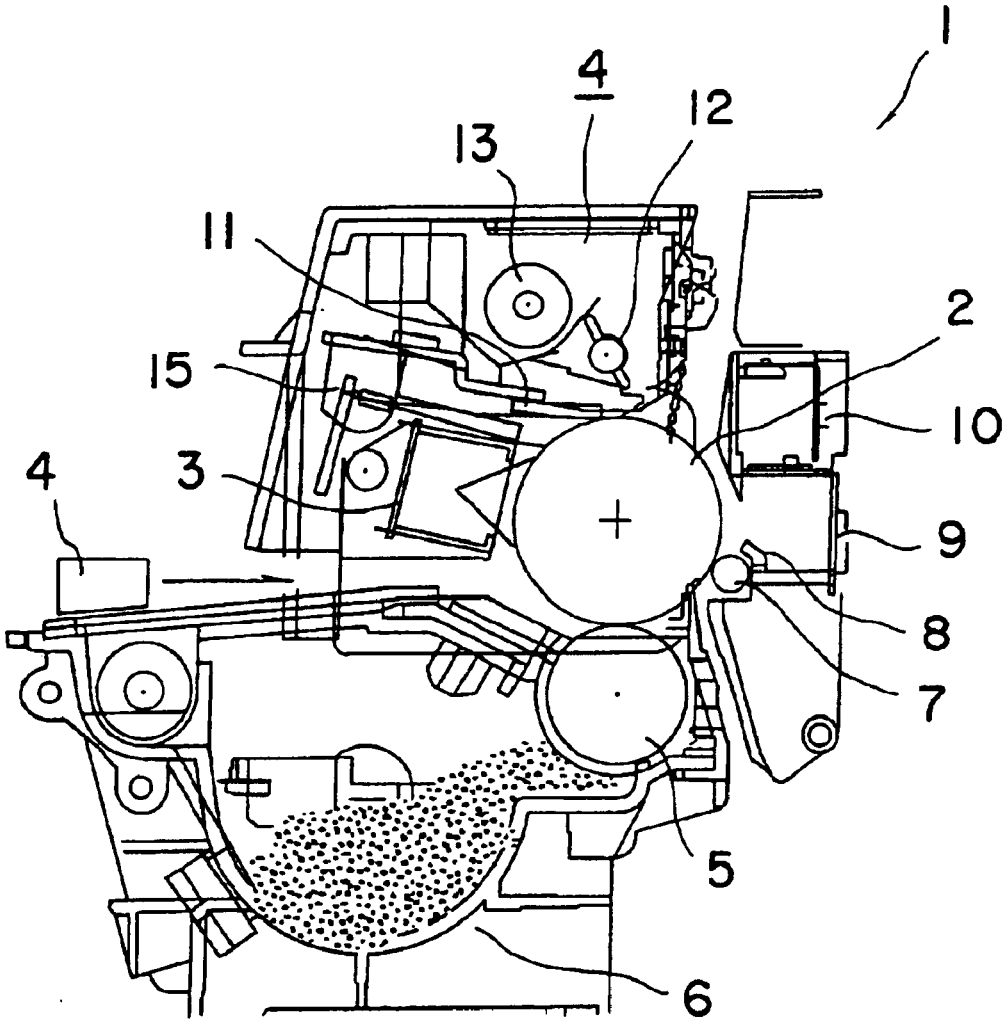
FIG. 1 is a sectional view of a main part of an image forming apparatus according to an aspect of the invention.

As illustrated in FIG. 1, an image forming apparatus 1 is substantially constituted by a photosensitive drum 2, a charging device 3 which has a surface of the photosensitive drum 2 charged, an exposing device 4 such as a semiconductor laser which irradiates a light beam onto the surface of the photosensitive drum 2 to form a desired electrostatic latent image, a developing device 6 having a developing roller 5 which carries and transports toner, which visualizes the electrostatic latent image formed on the surface of the photosensitive drum 2, a transfer device 9 attaching a roller before transfer 7 and a shielding plate 8, which transfer a toner image formed on the surface of the photosensitive drum 2 to the recording paper, a separating device 10 which separates the recording paper from the surface of the photosensitive drum 2, a cleaner 14 provided with a cleaning blade 11 which cleans remaining toner on the surface of the photosensitive drum 2, a transporting paddle 12, a spiral auger 13 and so on, a toner collecting device (not shown) which transports the cleaned toner to a collecting box, and a discharging device 15 which removes remaining charge on the surface of the photosensitive drum 2.

In the image forming apparatus 1, an image-forming will be performed as follows.

First, a surface of the photosensitive drum 2 is charged a desired charging voltage Vo (for example −630 [V]) by the charging device 3, and next, the surface of the photosensitive drum 2 is laser-exposed to form an electrostatic latent image. The surface-voltage on the exposed surface of the photosensitive drum 2 is attenuated, resulting in that the surface voltage of the latent image forming portion becomes a residual voltage Vr (for example −40[V]). After the electrostatic latent image is formed, a bias voltage (for example −460[V]), the polarity of which is the same as that of the surface of the photosensitive drum 2 (negative polarity), is applied onto the surface of the developing roller 5 of the developing device 6 and the developing process is performed using toner charged negative polarity (reverse development).

On the other hand, the roller before transfer 7 guides the recording paper to the transfer area. Toner image formed on the surface of the photosensitive drum 2 at the developing process is transferred to the surface of the recording paper by the transfer device 9 which has the recording paper charged positive polarity. Thereafter, the recording paper is removed from the surface of the photosensitive drum 2 by the removing device 10 which has the recording paper charged negative polarity. Remaining toner on the surface of the photosensitive drum 2 after transfer is cleaned by the cleaning blade 11. Toner accumulated on the edge of the cleaning blade 11 is scraped up by the transporting paddle 12 and transported by the spiral auger 13, resulting in that the toner is collected into the collecting box. Thereafter, remaining charge on the surface of photosensitive drum 2 is canceled by the discharging device 15.

Thus, image-forming will be consecutively performed on recording papers by repetition of the above-mentioned process.

Figure 2:
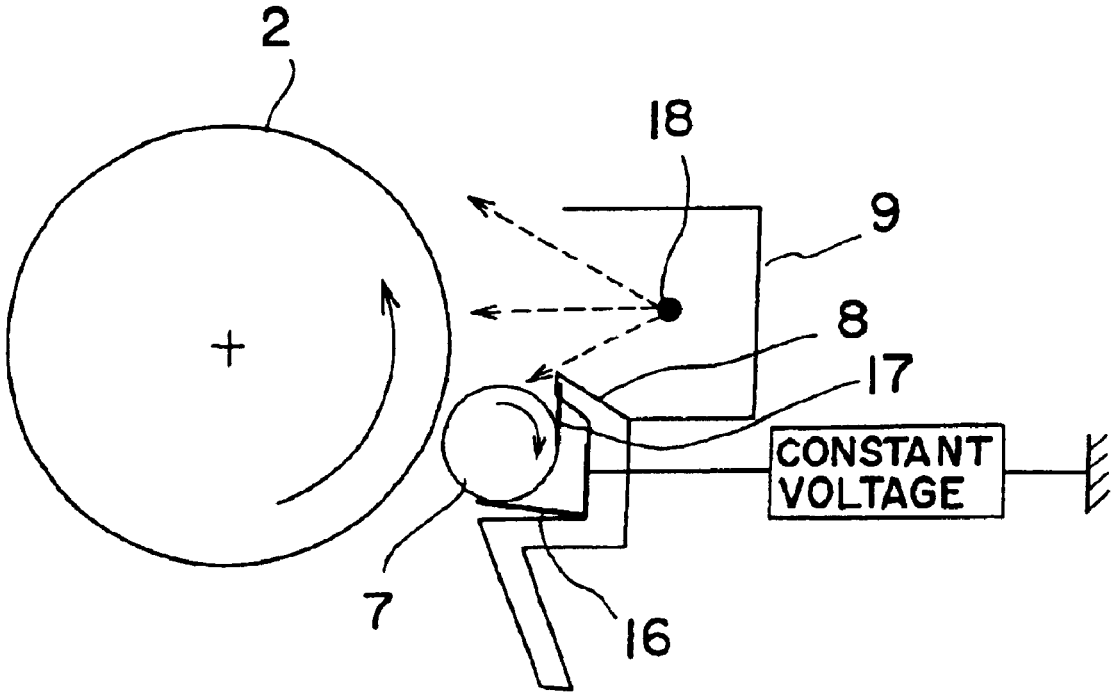
FIG. 2 is an enlarged sectional view in the vicinity of the transfer device in the image formation apparatus illustrated in FIG. 1.

In the image forming apparatus 1, the transfer device 9 attaches the roller before transfer 7 and the shielding plate 8, in which the roller before transfer 7 is abutted on a voltage adjusting thin plate 16 and a paper powder removing thin plate 17 as illustrated in FIG. 2.

As the material of the voltage adjusting thin plate 16 and the paper powder removing thin plate 17, a plastic film having splendid electric non-conductance, splendid mechanical strength, and also flexibility such as a two-axial extensible polyester film (for example "MILER"; the name of the product manufactured by DUPON CO.) and a two-axial extensibility polyethylene terephthalate film can be used.

Figure 3:
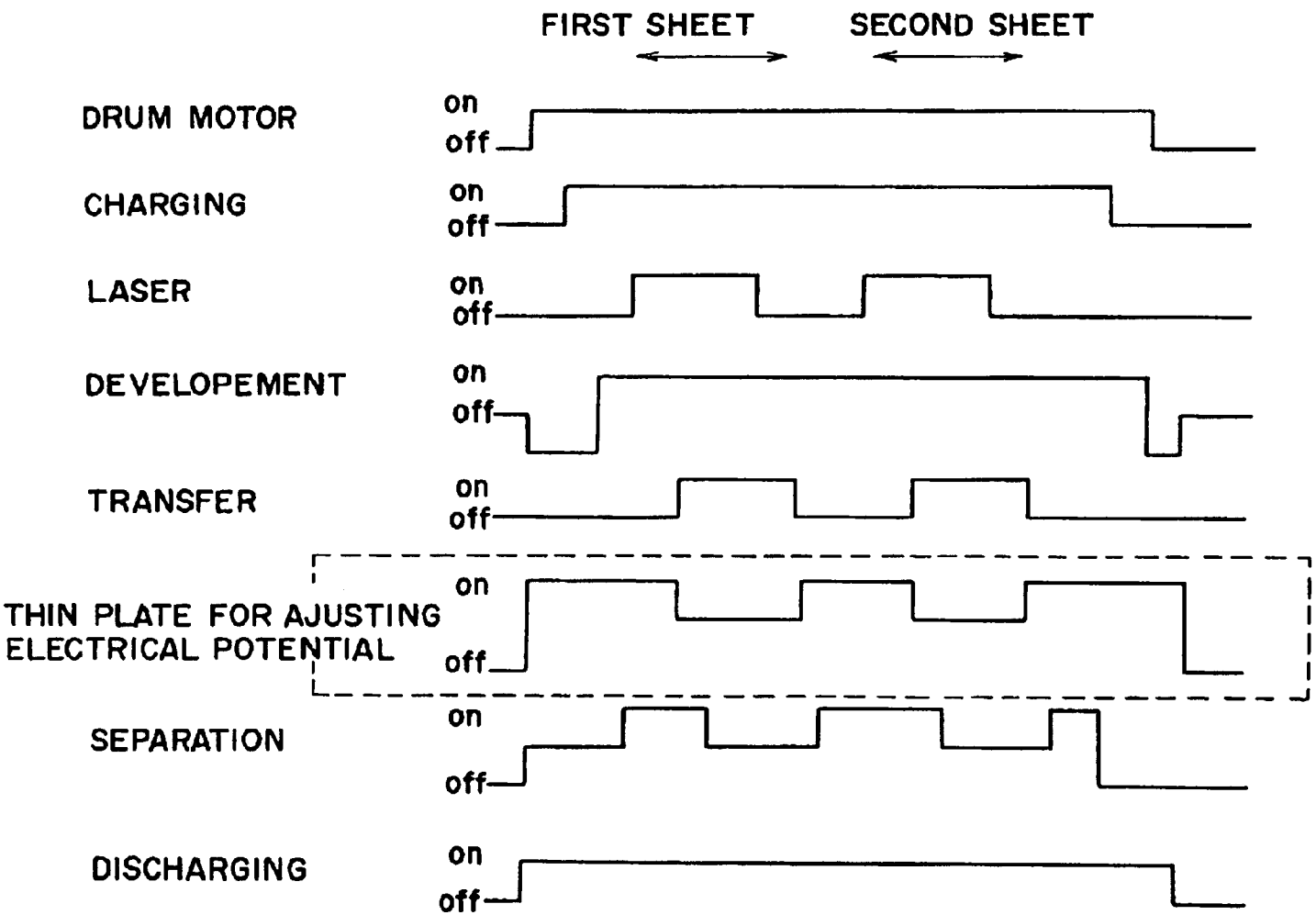
FIG. 3 is a timing chart while applying a voltage to each of constitutional elements in the image forming apparatus illustrated in FIG. 1.

As illustrated in FIG. 2, the voltage adjusting thin plate 16 is arranged below the roller before transfer 7 so as to be abutted on the surface of the roller before transfer 7 opposite to a location of a transfer wire 18 of the transfer device 9. Further, a bias voltage whose polarity is the same as a polarity of charging of toner (a negative polarity) is applied to the voltage adjusting thin plate 16. As illustrated in FIG. 3, this bias voltage is applied thereto only for a desired period, just after the image forming apparatus 1 is activated, just before the image forming apparatus 1 is stopped, and while voltage application to the transfer device 9 is being stopped.

In a case where the shielding plate 8 is merely arranged as illustrated in FIG. 2, it is inevitable that the surface of the roller before transfer 7 is discharged to carry a positive charge. However, if the voltage adjusting thin plate 16 to which a negative polarity bias voltage is applied is abutted on the surface of the roller before transfer 7, the charge on the surface thereof can be canceled. Therefore, it becomes hard to attract the scattered toner and/or the unexpected toner to be covered on the surface of photosensitive drum 2 and a phenomenon such that the surface of the roller before transfer 7 becomes dirty, resulting in making the back face of the recording paper dirty can be effectively overcome Because the above-mentioned arrangement of the voltage adjusting thin plate 16 can prevent the surface of roller before transfer 7 from being dirty particularly without extending the shielding plate 8, a discharging state from the transfer wire 18 is not shielded by the shielding plate 8, resulting in that efficiency of transfer is not deteriorated. Further, because the bias voltage of a negative polarity is directly applied to the surface of the roller before transfer 7 through the voltage adjusting thin plate 16, the positive charge existing on the roller before transfer 7 can be efficiently canceled.

Further, because the plastic film is used as the voltage adjusting thin plate 16, even when the surface of the roller before transfer 7 is made of material such as rubber having an anti-smoothing property, there occurs no vibration while the roller before transfer 7 is rotating, resulting in that the above-mentioned abutment can be evenly established in a longitudinal direction. Furthermore, because the plastic film can be bent or formed in another manner to be suitable shape, it does not matter regarding the space, resulting in that the voltage adjusting thin plate 16 can be arranged at suitable position.

As illustrated in FIG. 2, the paper powder removing thin plate 17 is arranged at a lateral side of the roller before transfer 7 and abutted on the surface of the roller before transfer 7 at the same side as a side where the transfer wire 18 of the transfer device 9 exists.

Thereby, paper powder, dust or the like attached to the surface of the roller before transfer 7 can be scraped and removed, resulting in preventing paper powder, dust or the like from remaining at the abutment portion of the voltage adjusting thin plate 16 and enabling to always apply a stable bias voltage to a portion evenly in the longitudinal direction of the surface of the roller before transfer 7.

EXAMPLE 1

In the image forming apparatus 1 illustrated in FIG. 1, referring to FIG. 2, the voltage adjusting thin plate 16 is arranged below the roller before transfer 7 so as to be abutted on the surface of the roller before transfer 7 located at the opposite side of the transfer wire 18 of the transfer device 9. Further, the paper powder removing thin plate 17 is arranged at a lateral side of the roller before transfer 7 so as to be abutted on the surface of the roller before transfer 7 at the same side as the side where transfer wire 18 of transfer device 9 is located. Two-axial extensible polyester film ("MILER"; the name of the product manufactured by DUPON Co.) is used as materials of the voltage adjusting thin plate 16 and the paper powder removing thin plate 17.

As shown in FIG. 3, the bias voltage is applied to the voltage adjusting thin plate 16 only for 0.1 minutes, just after the image forming apparatus 1 is activated, just after the image forming apparatus 1 is stopped, and while application of voltage to the transfer device 9 is being stopped. Further, the bias voltage applied to the voltage adjusting thin plate 16 is made to be changed into the voltage of 0 [kV] to −0.5 [kV]. Five sheets of A4-sized recording paper are consecutively printed by once-printing operation. After such printing operation is consecutively performed by two hundreds times, reflectivity of the surface of the roller before transfer 7 is measured, and further the states are visibly judged that the image formed on the recording paper might be slipped out and the dirt of toner might be left on the back face of the recording paper.

Figure 5:
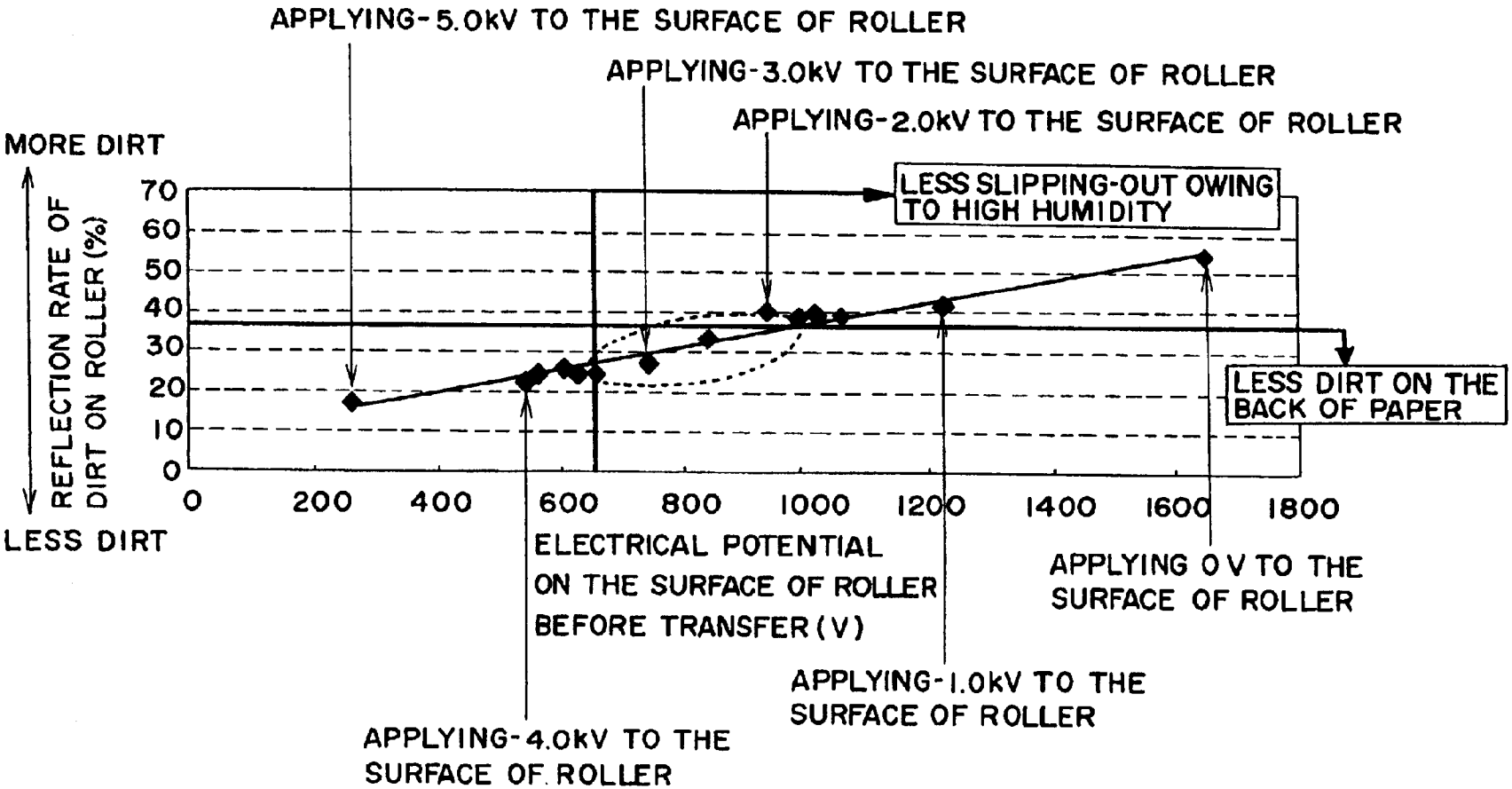
FIG. 5 is a graph where the table of FIG. 4 is shown schematically.

The results of the measurements and the judgments are indicated in FIG. 4 and FIG. 5. In FIG. 4, with respect to the slipping-out of the image, "○" indicates a splendid state that there is little slipping-out defect, "Δ" indicates a state that there partially exists slipping-out defect, and "X" indicates an extraordinarily defective state that there exists much slipping-out defect at various portions. On the other hand, with respect to the dirt on the back face of the recording paper, "○" indicates a splendid state that there is little dirt on the back face of the paper, "Δ" indicates a state that there partially exists dirt on the back face of the paper, and "X" indicates an extraordinarily defective state that there exists much dirt on the back face of the paper.

Referring to FIG. 4 and FIG. 5, if a bias voltage having an absolute value of 2.0 [kV] or more whose polarity is negative (−) is applied to the voltage adjusting thin plate 16, then it can be understood that a splendid state is maintainable such that there is little dirt on the back face of the recording paper. On the other hand, if a bias voltage having an absolute value of 3.6 [kV] or more whose polarity is negative (−) is applied to the voltage adjusting thin plate 16, then it can be understood that a state is maintainable such that there exists partially outstanding slipping-out at transfer process. Accordingly, it can be understood that the bias voltage whose value is −2.0 [kV] to −3.5 [kV] is preferably applied to the voltage adjusting thin plate 16.

Other embodiments of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A transfer device of an image forming apparatus employing an electro-photographic process comprising:

a roller arranged before a transfer area which is arranged at a position where a surface of said roller is affected by discharging from a transfer wire, and which guides a recording paper to a transfer area; and a voltage adjusting thin plate which is abutted on said surface of said roller, to which a bias voltage whose polarity is the same as a polarity of toner is applied, and which cancels electric charge from said surface of said roller.

2. The transfer device according to claim 1, wherein said bias voltage applied to said voltage adjusting thin plate has a negative polarity and an absolute value of 2.0 kV or more.

3. A transfer device of an image forming apparatus employing an electro-photographic process comprising:

a roller arranged before a transfer area which guides a recording paper to a transfer area; and a voltage adjusting thin plate which is abutted on a surface of said roller, to which a bias voltage whose polarity is the same as a polarity of toner is applied, and which cancels electric charge from said surface of said roller, wherein said bias voltage is applied to said voltage adjusting thin plate only for a desired period, at least, just after said image forming apparatus is activated and while an application of a voltage to said transfer device is being stopped.

4. The transfer device according to claim 1, wherein said voltage adjusting thin plate is made of two-axial extensible polyester film having flexibility.

5. The transfer device according to claim 1, further comprising a paper powder removing thin plate which is abutted on a surface of said roller arranged before the transfer area and which scrapes and removes paper powder, dust and the like attached to the surface of said roller arranged before the transfer area.

6. The transfer device according to claim 5, wherein said paper powder removing thin plate is made of two-axial extensible polyester film having flexibility.

7. An image forming apparatus employing an electro-photographic process, the apparatus comprising a transfer device, said transfer device comprising:

a roller arranged before a transfer area which is arranged at a position where a surface of said roller is affected by discharging from a transfer wire, and which guides a recording paper to a transfer area; and a voltage adjusting thin plate which is abutted on said surface of said roller, to which a bias voltage whose polarity is the same as a polarity of toner is applied, and which cancels electric charge from said surface of said roller.

8. The image forming apparatus according to claim 7, wherein said bias voltage applied to said voltage adjusting thin plate has a negative polarity and an absolute value of 2.0 kV or more.

9. An image forming apparatus employing an electrophotographic process, the apparatus comprising a transfer device, said transfer device comprising:

a roller arranged before a transfer area which guides a recording paper to a transfer area; and a voltage adjusting thin plate which is abutted on a surface of said roller, to which a bias voltage whose polarity is the same as a polarity of toner is applied, and which cancels electric charge from said surface of said roller, wherein said bias voltage is applied to said voltage adjusting thin plate only for a desired period, at least, just after said image forming apparatus is activated and while an application of a voltage to said transfer device is being stopped.

10. The image forming apparatus according to claim 7, wherein said voltage adjusting thin plate is made of two-axial extensible polyester film having flexibility.

11. The image forming apparatus according to claim 7, wherein said transfer device further comprises a paper powder removing thin plate which is abutted on a surface of said roller arranged before the transfer area and which scrapes and removes paper powder, dust and the like attached to the surface of said roller arranged before the transfer area.

12. The image forming apparatus according to claim 11, wherein said paper powder removing thin plate is made of two-axial extensible polyester film having flexibility.

* * * * *